US006021847A

United States Patent [19]

Daskopoulos et al.

[11] Patent Number: 6,021,847

[45] Date of Patent: Feb. 8, 2000

[54] REMOVING A WASTE COMPONENT FROM A HYDROCARBON FLUID

[75] Inventors: Phaidon Daskopoulos, Amsterdam; Alexander Michiel Mollinger, Rijswijk; Paul Dirk Schilte, Rijswijk; Robert Gerard Smeenk, Rijswijk; Paulus Henricus Joannes Verbeek, Rijswijk; Marinus Hendricus Wilhelmus Verbruggen, Rijswijk, all of Netherlands

[73] Assignee: Shell Oil Company, Houston, Tex.

[21] Appl. No.: 09/039,992

[22] Filed: Mar. 16, 1998

[30] Foreign Application Priority Data

Mar. 14, 1997 [GB] United Kingdom ..... 97200773

[51] Int. Cl.[7] ..... C10G 27/06; E21B 43/22

[52] U.S. Cl. ..... 166/310; 166/265; 166/267

[58] Field of Search ..... 166/265, 267, 166/310, 371, 304, 246; 405/128

[56] References Cited

U.S. PATENT DOCUMENTS

| | | | |
|---|---|---|---|
| 2,744,054 | 5/1956 | Pieters et al. | 208/196 |
| 3,506,572 | 4/1970 | Van Dyke et al. | 507/145 |
| 4,548,708 | 10/1985 | Schwarzer et al. | 208/196 |
| 4,566,965 | 1/1986 | Olmstead | 208/435 |
| 5,346,614 | 9/1994 | Culver et al. | 208/242 |
| 5,439,058 | 8/1995 | Malbrel et al. | 166/300 |
| 5,700,438 | 12/1997 | Miller | 423/228 |
| 5,730,871 | 3/1998 | Kennedy et al. | 210/512.2 |

FOREIGN PATENT DOCUMENTS

| | | |
|---|---|---|
| 0 227 291 A1 | 1/1987 | European Pat. Off. . |
| 2285055 | 6/1995 | United Kingdom . |
| 95/14543 | 6/1995 | WIPO . |

*Primary Examiner*—David Bagnell
*Assistant Examiner*—Chi H. Kang

[57] ABSTRACT

The invention relates to a method of reducing an amount of a waste component present in a hydrocarbon fluid produced from an earth formation via a wellbore formed in the earth formation, the hydrocarbon fluid flowing in a stream of fluid through the wellbore. The method includes the steps of: a) inducing at least part of the amount of the waste component to move into a second fluid present in the stream of fluid as the stream flows through the wellbore; and b) separating the second fluid with the at least part of the amount of the waste component included therein, from the hydrocarbon fluid.

17 Claims, No Drawings

REMOVING A WASTE COMPONENT FROM A HYDROCARBON FLUID

FIELD OF THE INVENTION

The invention relates to a method of reducing an amount of a waste component present in a hydrocarbon fluid in a stream of fluid produced from an earth formation.

BACKGROUND TO THE INVENTION

Many oil or gas wells produce, simultaneously with the desired hydrocarbon fluid, undesired waste components such as production water, $H_2S$ and $CO_2$. In the case of production water, the ratio of produced water/hydrocarbon fluid of most wells increases during the lifetime of the well. This phenomenon is due to the fact that for most hydrocarbon reservoirs in the earth formation the oil layer is located on top of a layer of water of which the level increases as the reservoir is depleted due to continued oil production. The produced water is generally separated from the oil using suitable separating means, for example settling tanks.

Apart from the produced water waste components like $H_2S$ and $CO_2$ are also produced in substantial amounts as these gases are dissolved in the produced oil and water. These components cause undesired environmental pollution if not adequately removed from the hydrocarbon fluid. It is therefore common technology to remove such waste components, for example using a regenerative treatment process. Such process requires a dedicated process plant downstream the wellbore at surface, which process plant is generally expensive and voluminous.

Another problem associated with the simultaneous production of corrosive waste components, such as $H_2S$ and $CO_2$, is accelerated corrosion of the hydrocarbon fluid production conduits (e.g. production tubings in the wellbore).

It is therefore an object of the invention to provide an improved method of reducing an amount of a waste component present in a hydrocarbon fluid in a stream of fluid produced from an earth formation, which method requires less dedicated process equipment and involves reduced corrosion of production conduits.

SUMMARY OF THE INVENTION

These and other objects are accomplished by a method of reducing an amount of a waste component present in a hydrocarbon fluid produced from an earth formation via a wellbore formed in the earth formation, the hydrocarbon fluid flowing in a stream of fluid through the wellbore: the method comprising a) inducing at least part of the amount of the waste component to move into a second fluid present in the stream of fluid as the stream flows through the wellbore; and b) separating the second fluid with the at least part of the amount of the waste component included therein, from the hydrocarbon fluid.

By moving the waste component into the second fluid as the stream of fluid flows through the wellbore it is achieved that a dedicated process plant at surface for moving the waste component into the second fluid stream is obviated. Furthermore, the high temperature and pressure of the fluid stream in the wellbore is advantageous for the above indicated step a). For example, quantities of gaseous waste components such as $H_2S$ or $CO_2$ have a relatively small volume under the high pressure conditions downhole, whereas such quantities would have a significantly larger volume at surface conditions necessitating correspondingly large surface processing equipment.

With the method of the invention it is further achieved that corrosive waste components like $H_2S$ or $CO_2$ are substantially absent from the production conduits downstream the separating step so that these conduits are not subjected to the corrosive action of the waste components.

To further reduce the amount of processing equipment at surface, it is preferred that the second fluid with the at least part of the amount of the waste component included therein is separated from the hydrocarbon fluid in the wellbore.

DESCRIPTION OF A PREFERRED EMBODIMENT

Preferably step a) comprises dissolving the at least part of the amount of the waste component in the second fluid, and step b) comprises separating the second fluid with the waste component dissolved therein, from the hydrocarbon fluid.

The method of the invention is particularly, but not exclusively, suitable for removing $H_2S$ and $CO_2$ from hydrocarbon fluid such as oil, because most produced oils contain dissolved $H_2S$ and $CO_2$ which should be prevented from being released to the atmosphere.

Suitably step a) comprises:

i) selecting a substance which reacts with the waste component to form a reaction product which is soluble in the second fluid;

ii) inducing the selected substance to be present in the stream of fluid in the wellbore, whereby the substance reacts with the waste component and the reaction product substantially dissolves in the second fluid of the stream of fluid.

The method of the invention is most efficient if the selected substance is induced to be present in a lower part of the wellbore where the hydrocarbon fluid enters the wellbore. This can be achieved, for example, by injecting the substance into the stream of fluid in the wellbore via a conduit extending into the wellbore.

In an attractive embodiment, the second fluid is production water produced simultaneously with the hydrocarbon fluid from the earth formation via the wellbore. The amount of selected substance to be used can be reduced by separating part of the production water from the stream of fluid prior to inducing the substance to be present in the stream of fluid, so that the reaction product substantially dissolves in the remaining part of the production water.

Suitably the second fluid with the included waste component is disposed by injecting it into the earth formation via the wellbore and/or via another wellbore. In this manner the waste components are returned to the earth formation from which they were produced, without causing any environmental pollution.

In case the waste components include $H_2S$ and $CO_2$, it is preferred to apply $OH^-$ ions in the stream of fluid so that the reaction product includes at least one of the group of $HS^-$, $S^{2-}$, $HCO_3^-$ and $CO_3^{2-}$ ions. The $OH^-$ ions can be formed by injecting a base into the stream of fluid, or alternatively by electrolysis of the second fluid, for example using a bipolar membrane.

The invention will be described in more detail in the following examples.

EXAMPLE 1

Hydrocarbon fluid in the form of oil and gas is produced from an earth formation via a wellbore. The stream of produced fluid flows to surface through a production tubing extending into the wellbore. Generally the stream of fluid includes a substantial amount of production water from the earth formation. Furthermore, waste components like $H_2S$ and/or $CO_2$ are also present as these components are dissolved in both the oil phase and the water phase. In order to remove $H_2S$ and/or $CO_2$ from the oil phase, a base in the form of NaOH is injected into the stream of fluid (e.g. by injecting it into the production tubing or into the annular space between the production tubing and the wellbore casing) so as to mix with the stream of oil and production water. The injected NaOH forms $OH^-$ ions in the water phase which react with $H_2S$ and $CO_2$ according to $$H_2S+OH^-HS^-+H_2O$$

$$HS^-+OH^-S^{2-}+H_2O$$

overall:

$$H_2S+2OH^-S^{2-}+2H_2O$$

$CO_2$ or $H_2CO_3$ ($CO_2+H_2O$) can react with a base according to $$H_2CO_3+OH^-HCO_3^-+H_2O \text{ or } CO_2+OH^-HCO_3^-$$

$$HCO_3^-+OH^-CO_3^{2-}+H_2$$

overall:

$$H_2CO_3+2OH^-CO_3^{2-}+2H_2O \text{ or } CO_2+2OH^-CO_3^{2-}+H_2O$$

wherein the ions $HS^-$, $S^{2-}$, $HCO_3^-$and $CO_3^{2-}$are dissolved in the water phase; only $H_2S$ and $CO_2$ can be dissolved in both the water- and the oil phase. Thus, by adding the base in the form of NaOH the concentration of the $HS^-$, $S^{2-}$, $HCO_3^-$ and $CO_3^{2-}$ ions in the water phase increases, leading to a decrease of $H_2S$ and $CO_2$ in the oil phase. This effectively implies a transfer of $H_2S$ and $CO_2$ from the oil phase to the water phase.

Optionally, before adding the base at least part of the production water is separated from the fluid stream, the loadvantage being that less amount of base is to be added in order to achieve the desired pH.

Conversely, when the concentration of $H_2S$ and $CO_2$ in the oil phase is relatively high, an extra injection water stream can be mixed with the total oil/water stream produced from the wellbore in order to create a larger water volume in which the $H_2S$ and $CO_2$ and the resulting ions are dissolved.

Subsequently the water phase in which the ions $HS^-$, $S^{2-}$, $HCO_3^-$ and $CO_3^{2-}$ are dissolved, is separated from the oil phase using one or more separators (for example cyclone separators) which can be positioned in the wellbore or at surface. The separated water with the dissolved ions is subsequently injected into the earth formation via an injection tubing extending in the wellbore. Alternatively the water with the dissolved ions can be injected into the earth formation via another wellbore. In case the above indicated ions have a tendency of scale precipitation in the injection tubing, a scale inhibitor or an acid can be added to the water stream in the injection tubing to prevent such scaling or to dissolve precipitated scale.

EXAMPLE 2

A stream of hydrocarbon fluid (oil/gas) containing $H_2S$ and $CO_2$ is produced from an earth formation via a production tubing in a wellbore, the difference from example 1 being that there is no water simultaneously produced from the formation. In order to apply the method according to the invention, a second fluid in the form of water is inserted into the stream of fluid by injecting the second fluid through a suitable conduit into the stream of fluid via the wellbore. The amount of second fluid to be injected depends on the amounts of $H_2S$ and $CO_2$ in the hydrocarbon fluid, but generally (in case of oil production) an amount as low as 2–3 wt % of the oil flow rate is sufficient.

The second fluid is injected so as to mix with the hydrocarbon fluid in the annular space between the production tubing and the wellbore casing, at the level of the producing zone. Prior to injecting the water into the hydrocarbon fluid stream, NaOH has been added to the water which furthermore has been made substantially free of scale-forming components like barium, strontium and calcium. NaOH forms $OH^-$ ions in the water phase, which react with the $H_2S$ and $CO_2$ present in the stream of fluid according to the reactions referred to in example 1. It is thereby achieved that effectively the $H_2S$ and $CO_2$ are moved into the second fluid, i.e. into the water phase. The water with the dissolved $HS^-$, $S^{2-}$, $HCO_3^-$ and $CO_3^{2-}$ ions is produced to surface where it is separated from the hydrocarbon fluid. Alternatively, the step of separating the water with the dissolved ions from the a hydrocarbon fluid can be carried out in the wellbore. In the latter case, small sized cyclone separators fitting in the wellbore, can be applied.

The separated water with the dissolved ions can be injected into the earth formation via the same or another wellbore, or it can be treated so as to remove waste components therefrom. In the latter case, for example precipitate forming components which react with the dissolved ions (e.g. to form salts) can be added to the water. The precipitate is subsequently removed from the water.

The contact between water and the oil can be intensified for example by using a contactor, a pump for pumping the stream of oil and water, or a centrifuge.

It will be appreciated that in the above examples NaOH has been indicated as a suitable substance to be added to the fluid stream only by way of example, and that there are numerous other substances which are suitable for carrying out the method of the invention. Examples of such substances are $Ca(OH)_2$, $Mg(OH)_2$, LiOH and KOH.

The amount of base to be used in applying the invention can be determined from stoichiometric conditions. For example, approximately 1.82 kg NaOH would be needed per kg $CO_2$ to be removed, and approximately 2.22 kg NaOH would be needed per kg $H_2S$ to be removed.

It will be appreciated that the method according to the invention can be applied both at onshore and offshore oil/gas production wells.

In an alternative embodiment of the method according to the invention, $H_2S$ can be removed from the hydrocarbon fluid by conversion into $HS^-$ and/or $S^{2-}$ using suitable bacteria which are supplied to the stream of fluid.

Furthermore, certain amines can be applied to bind or convert $CO_2$ present in the hydrocarbon fluid.

We claim:

1. A method for reducing an amount of a waste component present in a hydrocarbon fluid produced from an earth formation via a wellbore formed in the earth formation, the hydrocarbon fluid flowing in a stream of fluid through the wellbore, the method comprising the steps of:

a) inducing at least part of the amount of the waste component to move into a second fluid present in the stream of fluid as the stream flows through the wellbore and dissolving the at least part of the amount of the waste component in the second fluid; and b) separating the second fluid with the waste component dissolved therein, from the hydrocarbon fluid.

2. The method of claim 1, wherein the waste component comprises at least one of $H_2S$ and $CO_2$.

3. The method of claim 1 wherein step a) further comprises:

i) selecting a substance which reacts with the waste component to form a reaction product which is soluble in the second fluid;

ii) inducing the selected substance to be present in the stream of fluid in the wellbore, whereby the substance reacts with the waste component and the reaction product substantially dissolves in the second fluid.

4. The method of claim 3 wherein step ii) further comprises inducing the substance to be present in a lower part of the wellbore where the hydrocarbon fluid enters the wellbore.

5. The method of claim 3 wherein the waste component comprises at least one of $H_2S$ and $CO_2$, and wherein the substance includes $OH^-$ ions, the reaction product including at least one of the group of $HS^-$, $S^{2-}$, $HCO_3^-$ and $CO_3^{2-}$ ions.

6. The method of claim 5 wherein the $OH^-$ ions are formed by at least one of the steps of injecting a base into the stream of fluid, and performing electrolysis of the second fluid.

7. The method of claim 6 wherein the substance is injected into the stream of fluid in the wellbore via a conduit extending into the wellbore.

8. The method of claim 3 wherein the second fluid is production water produced simultaneously with the hydrocarbon fluid from the earth formation via the wellbore and prior to inducing the substance to be present in the stream of fluid, part of the production water is separated from the stream of fluid, whereby the reaction product substantially dissolves in the remaining part of the production water.

9. The method of claim 3, wherein the second fluid is inserted in the stream of fluid by injecting it into the stream of fluid via the wellbore and the substance is dissolved in the second fluid, the second fluid with the dissolved substance being injected into the stream of fluid.

10. The method of claim 1 wherein the second fluid is production water produced simultaneously with the hydrocarbon fluid from the earth formation via the wellbore.

11. The method of claim 1 wherein the second fluid is inserted in the stream of fluid by injecting it into the stream of fluid via the wellbore.

12. The method of claim 11 wherein prior to injecting the second fluid into the stream of fluid, the second fluid is made substantially free of scale-forming components.

13. The method of claim 1 further comprising after step b), removing the waste component from the second fluid.

14. The method of claims 13, wherein a selected compound is added to the second fluid which reacts with the waste component so as to form a precipitate which includes the waste component, whereafter the precipitate is removed from the second fluid.

15. The method of claim 1 comprising the further step of disposing the second fluid with the waste component included therein by injecting it into the earth formation via at least one of the wellbore and another wellbore formed in the earth formation.

16. The method of claim 1 wherein the step of separating the second fluid with the at least part of the amount of the waste component included therein, from the hydrocarbon fluid, is carried out in the wellbore.

17. The method of claim 1 wherein the second fluid comprises water.

* * * * *